US007938350B2

(12) United States Patent
Doppstadt et al.

(10) Patent No.: US 7,938,350 B2
(45) Date of Patent: May 10, 2011

(54) KNIFE HOLDER FOR COMMINUTION DEVICES

(75) Inventors: Johann Doppstadt, Velbert (DE); Horst Berger, Calbe (DE)

(73) Assignee: Doppstadt Calbe GmbH, Calbe (Saale) (DE)

( * ) Notice: Subject to any disclaimer, the term of this patent is extended or adjusted under 35 U.S.C. 154(b) by 774 days.

(21) Appl. No.: 10/591,069

(22) PCT Filed: Sep. 16, 2005

(86) PCT No.: PCT/EP2005/010017

§ 371 (c)(1),
(2), (4) Date: Aug. 30, 2006

(87) PCT Pub. No.: WO2006/029897

PCT Pub. Date: Mar. 23, 2006

(65) Prior Publication Data

US 2007/0194161 A1 Aug. 23, 2007

(30) Foreign Application Priority Data

Sep. 16, 2004 (DE) ..... 20 2004 014 546 U
Jun. 21, 2005 (DE) ..... 20 2005 009 859 U

(51) Int. Cl.
*B02C 1/10* (2006.01)

(52) U.S. Cl. ..... 241/294

(58) Field of Classification Search ..... 241/294, 241/293, 292.1
See application file for complete search history.

(56) References Cited

U.S. PATENT DOCUMENTS 5,873,534 A 2/1999 Shinn ..... 241/294

FOREIGN PATENT DOCUMENTS

| | | | |
|---|---|---|---|
| DE | 9402062 | | 8/1994 |
| DE | 20021216 | | 4/2001 |
| DE | 20116344 | | 1/2002 |
| EP | 771911 | A1 * | 5/1997 |
| EP | 1304169 | A2 | 4/2003 |
| WO | WO 94/14540 | | 7/1994 |
| WO | WO94/14540 | | 7/1994 |

* cited by examiner

*Primary Examiner* — Dana Ross
*Assistant Examiner* — Matthew G Katcoff
(74) *Attorney, Agent, or Firm* — Jacobson Holman PLLC

(57) ABSTRACT

The invention refers to a knife holder for comminution devices, comprising a tooth body (1) which can be fastened on a comminution cylinder or the like, and at least one knife (2), the knife (2) being able to be arranged positive-locking on the tooth body (1).

Figure 1:
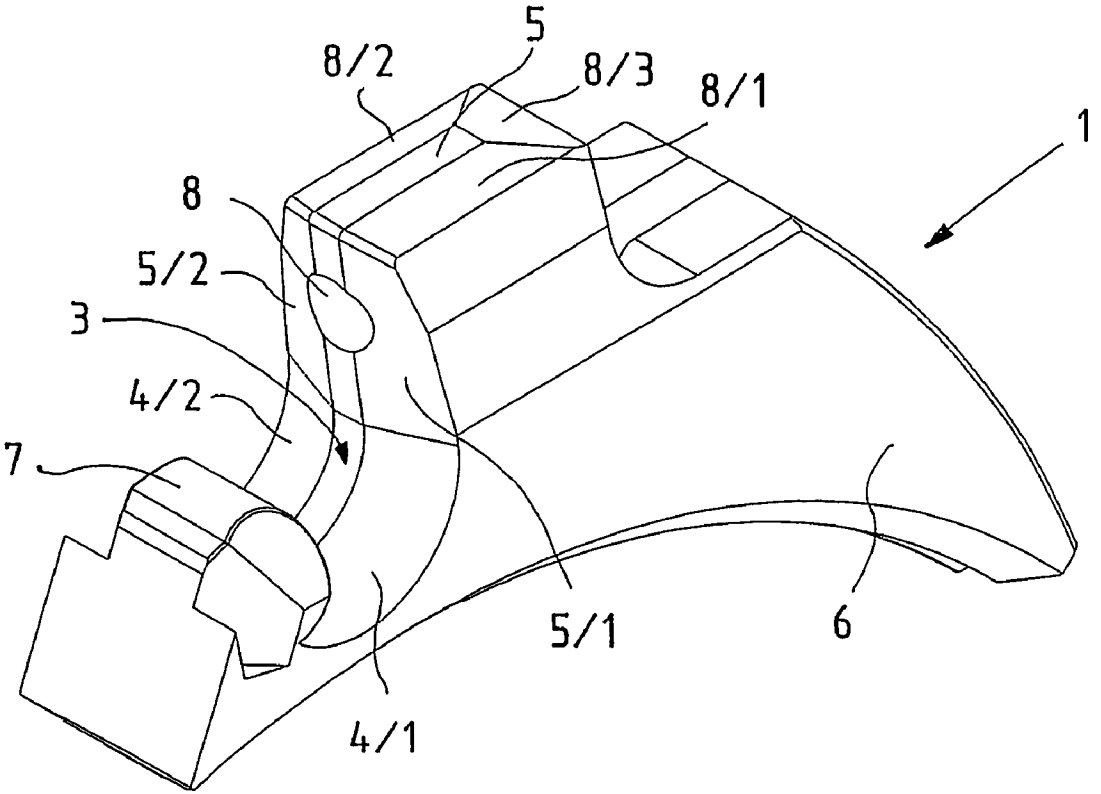

The invention is characterized by the fact that a knife receiving device is provided, the knife receiving device (3) is designed as recess (4), and, seen from the side, has the shape of a J, and the recess (4) is designed wedge-like or conically, preferably tapering-off to the outside in such a way that recess surfaces (4/1, 4/2) occur.

24 Claims, 14 Drawing Sheets

KNIFE HOLDER FOR COMMINUTION DEVICES

This is a nationalization of PCT/EP2005/010017 filed 16 Sep. 2005 and published in German.

The invention refers to a knife holder for comminution devices, comprising a tooth body attachable to a comminution cylinder, and at least one knife.

Knife bodies of this kind are known. They are used in comminution devices, in particular in waste comminution devices for waste recycling or the like. For different comminution problems here different knives are required. The knives also differ in shape and the material they are made off depending on the material to be disintegrated. In order to change knives different technical solutions are known.

It is known to design the knife holders according to the required shape of the knives. Thus a change of the knife holder is necessary when the knife is exchanged. As the wear of knives and knife holders is very high this regularly causes difficulties. The effort for a change is large and expensive.

It is also known to provide the cylinders for the use of different knives with respective knife holders, and to exchange the cylinders for altered comminution problems. This modification is also very expensive.

Furthermore it is known to provide cylinder segments on cylinder base elements, and to equip them with knife holders. Here the respective cylinder segments have to be exchanged when the comminution problem changes. Here also the expenses for this exchange are quite high.

In the disclosure DE 200 21 216 U1 a milling tooth for a comminution machine is known which can be at least partly positive-locking attached to a milling tooth holder of a comminution machine.

In the disclosure G 94 02 062.0 a multiple comminution beetle for organic waste materials is known where the cutting part is connected positive and non-positive locking via a screw or clamping connection with a holding device.

In the disclosure EP 1 304 169 A2 a comminution device for industrial waste is known where the comminution tools are provided on a comminution cylinder. Here also the knives are attached to a knife holder positive and non-positive locking.

The disadvantages described further above are given in the same way in the solutions known from the disclosures.

Therefore it is an object of the invention to provide a knife holder which makes the exchange of the knives easier, when the comminution problem changes and the knives are worm, reduces the expenses and minimises the wear of the knives.

The problem of the invention is solved by a knife holder for comminution devices, comprising a tooth body attachable to a comminution cylinder or the like, and at least one knife, the knife being able to be arranged positive-locking at the tooth body, a knife receiving device being provided, which is characterised in that the knife receiving device is designed as recess, and has, seen from the side, J-shape, and the recess is designed wedge-like or conically, preferably tapering-off to the outside, in such a way that recess surfaces occur. By designing the knife holder as tooth body which receives the knife positive-locking, several advantages appear at the same time.

Thus the effort for changing a knife is considerably made easier and thus reduced. The knives can be inserted in a very simple way in the tooth body, and also be removed. The positive-locking arrangement in the recess serves, at the same time, also as a centering of the knife on the tooth body. The use of very different knives is now possible according to the invention. It is only necessary to design the positive-locking connection of knife and tooth body accordingly. The knife-edges may now be of different shapes and materials. An exchange of the knife holders or an exchange of the cylinders, respectively cylinder segments, as described in the state of the art, is not necessary anymore. Thus the use of the comminution device itself becomes considerably more variable and economic. The wear and period of operation of the knives and the knife holders is extended considerably as the knife in the recess is supported now by the recess surfaces because it is designed corresponding to them.

The variant of positive-locking attachment of the knife has the advantage of an additional fastening possibility for the knife. As the knives are regularly stressed a lot this fastening possibility means an additional safety procedure.

A knife holder according to the invention is characterised by the fact that the knife is attached to the tooth body in a fixed releasable way. The fixed releasable arrangement generates other advantages, in particular with regard to the comfort of handling.

According to the invention it has been found to be an advantage if a knife receiving device is provided in which at least a part of the knife can be put in. Thus all useful shapes of knives may be bound to the shape of the knife receiving device. However, an exchange of the knives is now made considerably easier and the time needed for the exchange is reduced.

It is convenient here if the knife receiving device is arranged at the front end seen in the direction of cutting. Of course, it is also possible to provide other points at the tooth body for arranging the knife receiving device. The arrangement described before, however, has turned out to be convenient also for the design of the individual kinds of knives.

The knife receiving device is designed, according to a modification of the invention, as a recess, and has, seen from the side, J-shape. The J-shape has the advantage that thus in an easy way the knife can be set in the knife receiving device. The J-shape guarantees here the positive-locking connection with automatic adjustment in a very impressive way.

Another optimising of the adjustment and the positive-locking connection is obtained, according to a development of the invention, by the fact that the recess has a nose on its front end, seen in the direction of cutting.

Conveniently here the nose of the recess is designed cylinder-like.

A knife holder, as described above, is characterised by the fact that the recess is designed wedge-like or conically, preferably tapering-off to the outside, in such away that recess surfaces are formed. These surfaces provide another optimising of the centering performance of the knife when the knife has the surfaces corresponding to it.

Another aspect of the knife holder according to the invention is given by the fact that a part of the tooth body is designed as supporting body. This part also serves for centering the knife, in particular, however, also for a better distribution of the stress of the forces applied at the knife during the cutting procedure, respectively disintegrating procedure.

It is another advantage here when the face of the supporting body facing the knife is provided with supporting surfaces which are wedge-shaped or conically tapering-off to the outside. On the one hand, these supporting surfaces serve for improving the automatic adjustment of the knife during putting-in, on the other hand, however, they optimise the balance of stress.

A design of the knife body according to the invention therefore provides that the tooth body and the knife have shapes corresponding with each other. The advantages arising by this have already been described.

According to another development of the invention it is provided that the tooth body is fastened on, respectively at, the comminution cylinder of the comminution device by means of welding. However, the invention is not limited to welding as means of attachment. It is rather possible to arrange the tooth body on the comminution cylinder by very different fastening means or methods. For example, screw, wedge, groove and tongue connections or the like are listed.

According to another modification the invention is characterised by the fact that the tooth bodies can be arranged on the comminution cylinder, in particular staggered to one another on the comminution cylinder. The angularly staggered arrangement has several advantages at the same time. Thus, for example, the distribution of stress during disintegration is optimised and the chance is created to arrange the tooth bodies helicoidally on the cylinder, and to influence thus the disintegration performance positively.

An aspect of the invention is characterised according to a development by the fact that the tooth body has on its bottom side, respectively the side facing the comminution cylinder, a centering device for centering on the cylinder.

A knife holder as described before is characterised by the fact that the centering device of the tooth body is designed a groove or tongue, which corresponds with the tongue or groove provided on the comminution cylinder, and interacts with it positive-locking. This makes arranging and/or fixing the knife holder considerably easier. Adjustment of the knife holder on the cylinder body of the comminution cylinder is carried out automatically. Even if subsequently fastening by welding is carried out no additional adjustment or re-arranging is necessary.

According to the invention it is furthermore provided that tooth body and knife have fastening means by means of which they can be fastened to each other in a fixed releasable way.

It is also convenient when the fastening means is at least one screw connection which is guided through borings in the tooth body and in the knife. It has turned out here in particular convenient to provide nuts in opposite direction of the cutting direction in order to make subsequent releasing easier. If a boring with a thread is used for the screw connection, there may be difficulties during releasing the connection, because the screw cannot be turned in the thread anymore. A nut projecting at the back can be blown in such a case or may be very easily removed, for example by separating through welding or cutting.

The boring has, according to a preferred modification for the fastening means, a diameter of 23 cm into which a suitable screw can be introduced.

Furthermore it has been found to be convenient when the tooth body and/or the knife are made from metal, preferably as castings. This makes the production of such elements considerably easier. Also different shapes can be obtained easily.

It is furthermore an advantage when the side faces of the tooth body taper off diagonally upward, taper or taper off to the outside radius, respectively. This is positive for the cutting result.

It is also provided here that the tooth body is designed narrower in the opposite direction of the cutting direction than at the cutting edge.

A development of the knife holder according to the invention provides that the outside radius of the tooth body at its side opposite the knife receiving device cuts the outside radius of the comminution cylinder.

This radius can be adapted preferably to different heights of the teeth. That means that if different teeth with altered heights of the teeth are used, the radius has to be adjusted accordingly in order to get the favourable cutting and supporting features of the tooth.

The knife holder according to the invention provides also an embodiment where the knife receiving device is designed in such a way that knives with different knife shapes, for example triangle, rectangular, respectively polygon, knives can be used, respectively fastened.

It is furthermore an advantage if the knife is designed like a tooth. According to the invention the tooth has a knife-edge, and is designed concave on its side facing the cutting direction.

The tooth also is provided, according to a convenient modification of the invention, on its side opposite the tooth body with a radius which preferably cuts the radius of the cylinder, respectively the cylinder body.

A development of the knife holder provides that at the tooth a supporting region is provided which is supported by the supporting body of the tooth body. This leads to an improvement of the automatic adjustment of the tooth on tooth body, as already described.

The supporting region of the tooth also has conically or wedge-like running supporting surfaces which interact with the supporting surfaces of the tooth body.

The tooth is designed preferably wider than the toothed body in such a way that free cutting is obtained. This reduces the wear of the tooth body, and the cutting performance altogether is improved.

A development of the invention provides that the tooth is designed on the faces facing the tooth body corresponding with the recess surfaces and the supporting surfaces conically, respectively wedge-like, in such a way that automatic centering occurs by positive-locking during fastening the tooth. The effect of this modification has been already described above.

A knife holder as described before is, according to a development of the solution of the invention, characterised by the fact that two sides facing the tooth body and orientated downward to the recess are designed as recess counter surfaces, and the inclination of these surfaces corresponds with the inclination of the recess surfaces. This guarantees automatic centering in this region.

It is furthermore provided according to the invention that two sides facing the tooth body and orientated horizontally are designed as supporting surfaces, and the inclination of these surfaces corresponds with the inclination of the supporting surfaces. This makes sure that also in the region of the supporting surfaces a positive-locking and automatic centering connection is obtained.

Another means which serves for automatic centering as well as for better support of the forces applied to the tooth, is effected, according to a development, by two sides facing the placing surfaces as placing counter surfaces. The placing counter surfaces also have an inclination corresponding to the placing surfaces, and thus serve also for supporting and automatic centering in this region.

According to the invention it has been found to be an advantage if the size of the tooth can change. Here in particular the height between the tip of the knife-edge and the outside radius of the comminution cylinder is measured. The size of the tooth can now be selected depending on different comminution problems. That means that comminution cylinders with different teeth are supplied, or for larger orders for disintegration the teeth on the comminution cylinder itself can be exchanged. The height of the teeth is then adapted to the respective comminution problem. The height of the tooth is preferably between 100 mm and 200 mm.

Of course it is, according to the invention, also provided that the tooth has a placed-upon knife edge made preferably from hard metal. The life time of teeth of this kind is considerably longer than of teeth made from usual materials like casting or tool steel.

It is also convenient when the tooth has at least one hardened region at the edges orientated in the direction of cutting.

The hardened region(s) are obtained, for example, by arming or welding-on.

Another aspect of the invention is given by the fact that the tooth is designed in two pieces. The two-piece tooth is here formed preferably by a first cutting body and a second cutting body.

The first cutting body is here designed flatly, respectively evenly, on the side facing the second cutting body.

A development is characterised by the fact that the second cutting body is designed disc-like and has an opening which embraces in the built-in condition the nose of the tooth body.

The second cutting body of the two-piece tooth is designed preferably as interchangeable disc which, in an advantageous development, has a thickness of 20 mm. The interchangeable disc has here the shape of a triangle which can be put up on one of its edges essentially horizontally, and which is flattened on its side which is on top in built-in condition. The flattening is done in such a way that the interchangeable disc has then the form of a trapezoid. Of course, also other possibilities for flattening are comprised by this modification of the invention according to the invention. Thus it is, for example, possible that the flattening is designed rounded, preferably concavely. Of course, also a convex rounding of the interchangeable disc in its uppermost top region is provided according to an embodiment.

The invention also refers to a comminution device with at least one knife holder according to one or more of the embodiments, respectively modifications, described before.

A comminution device as described before is characterised by a number of knife holders which are arranged on the comminution cylinder, in particular staggered to each other.

In the following the invention is described by means of examples.

Figure 2:
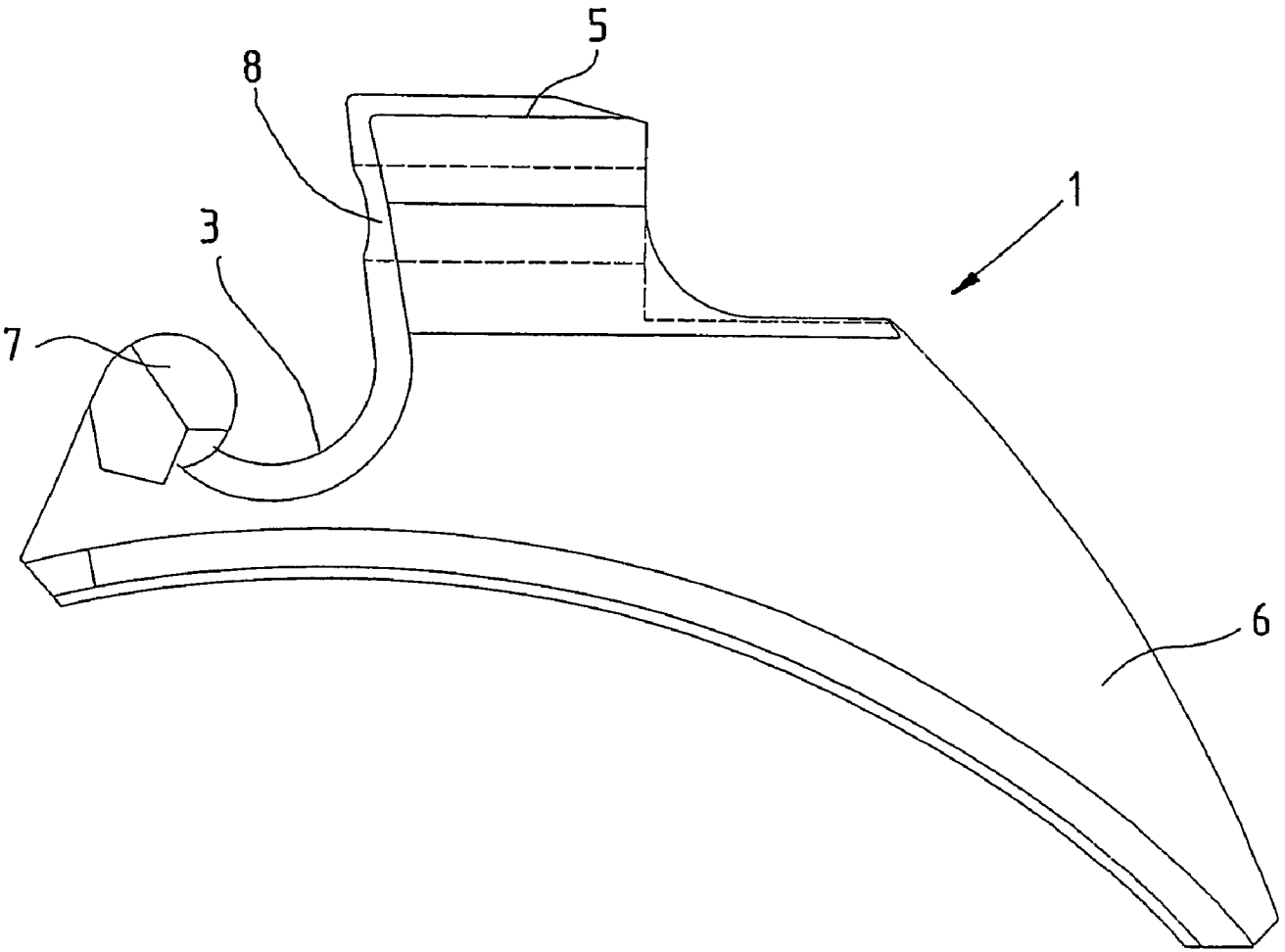
Figure 3:
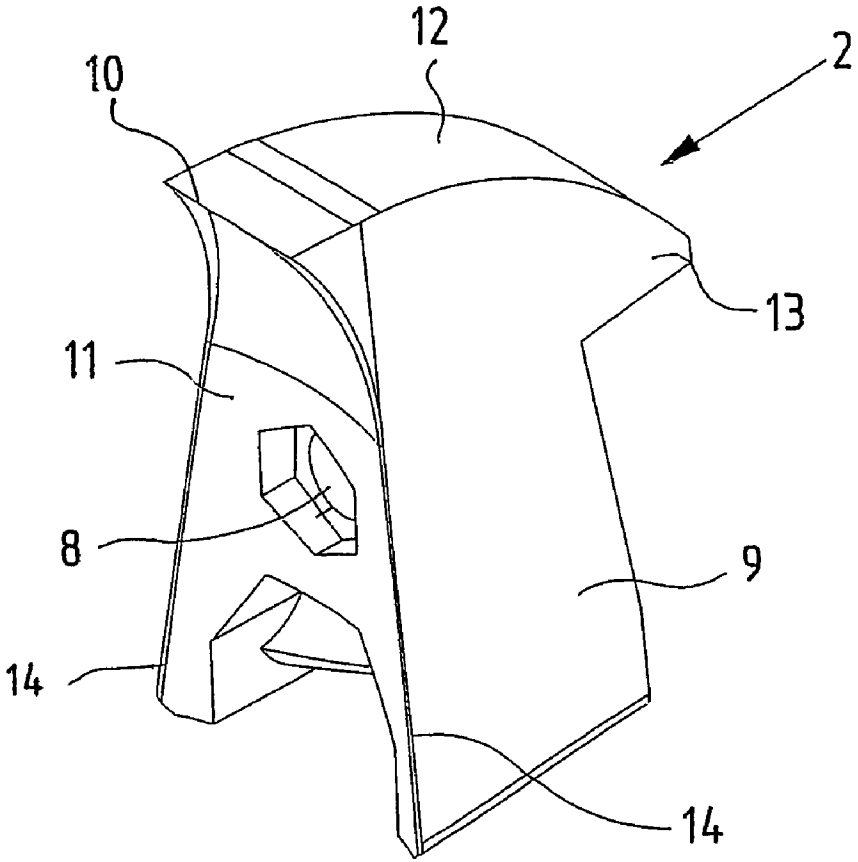
Figure 4:
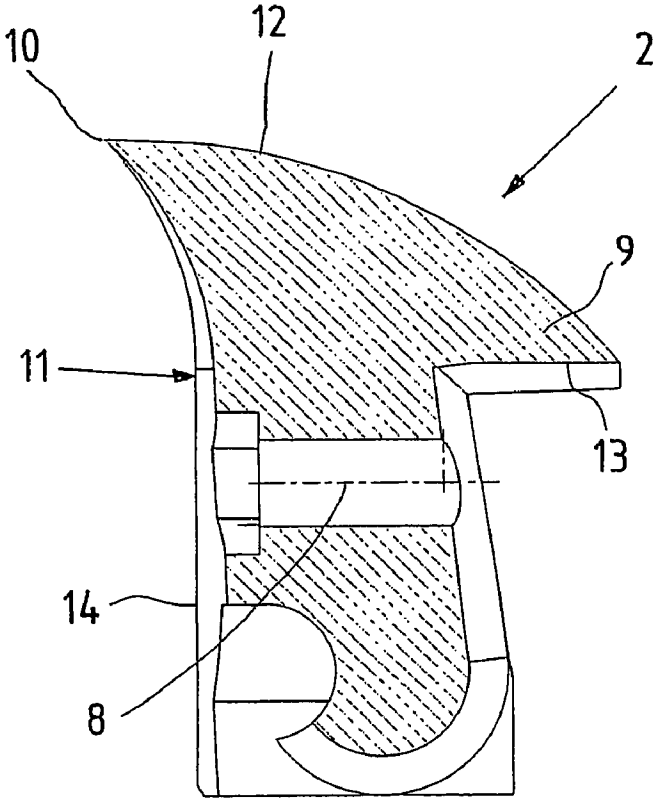
Figure 5:
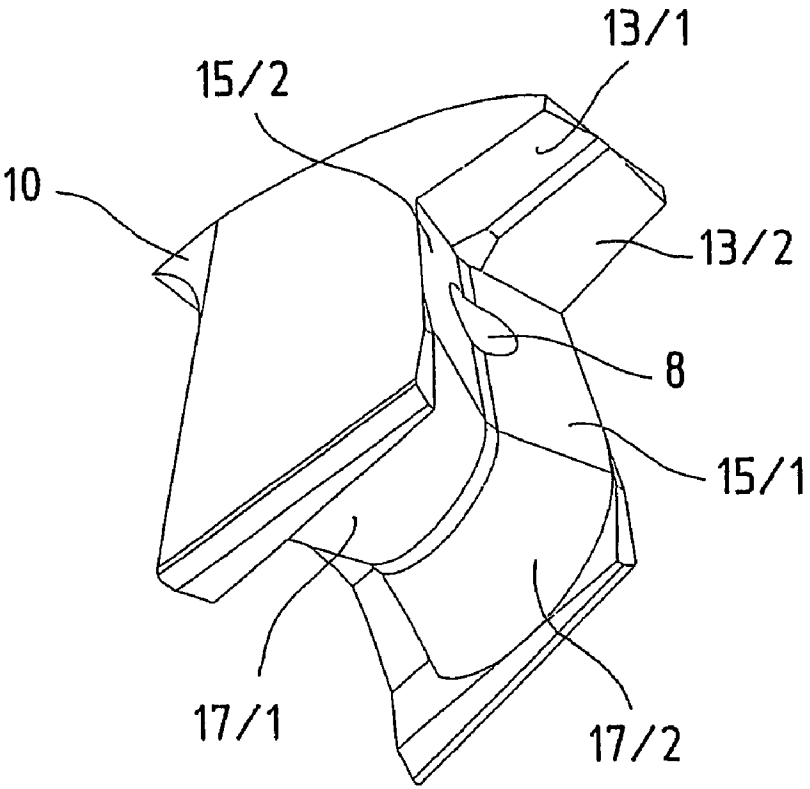
Figure 6:
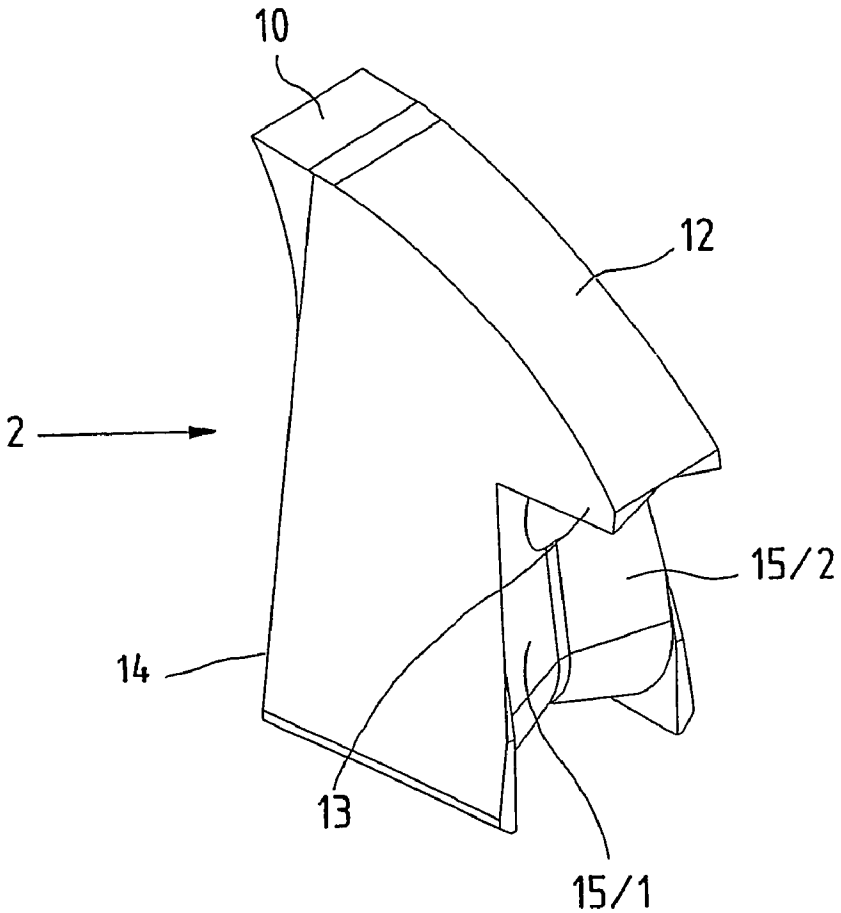
Figure 7A:
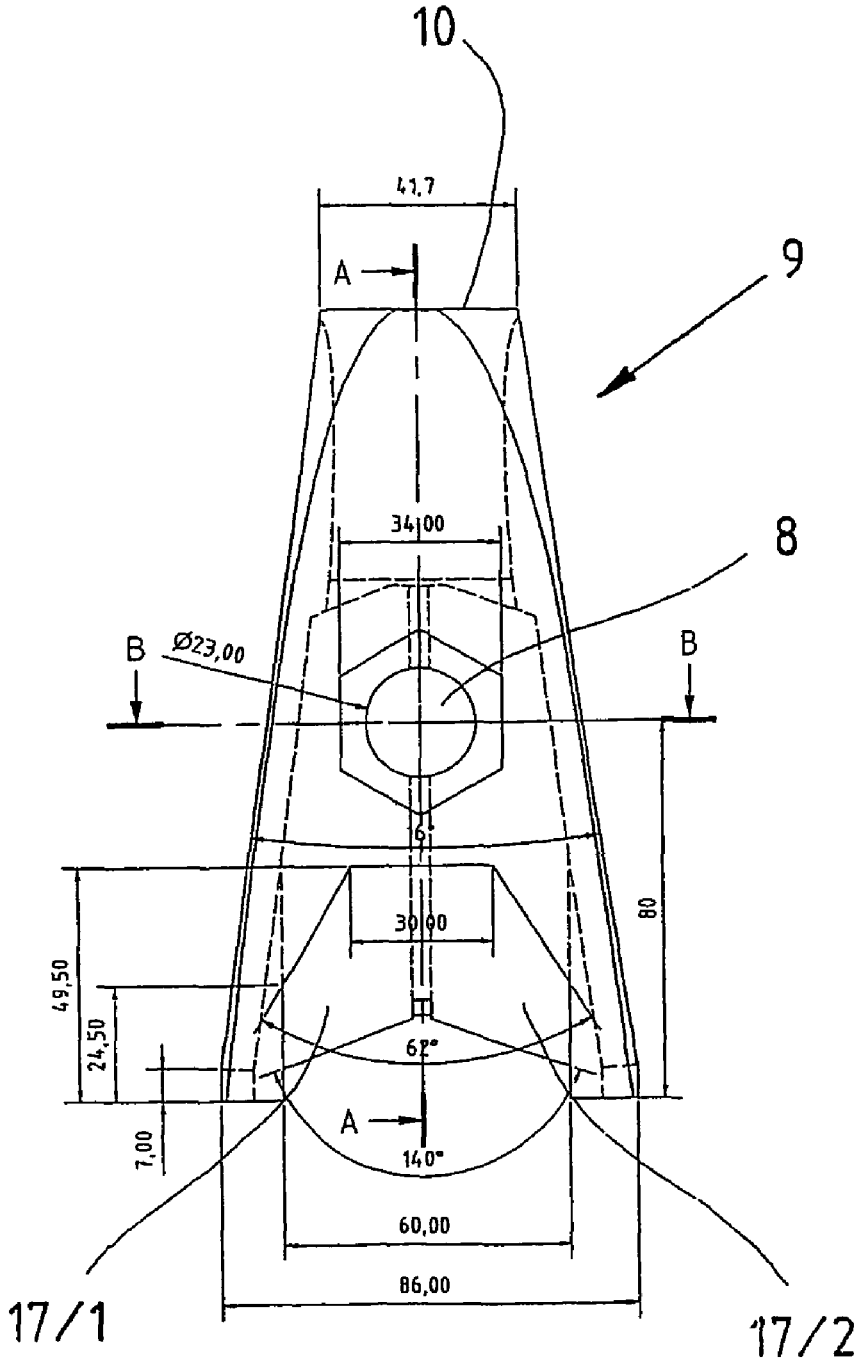
Figure 8A:
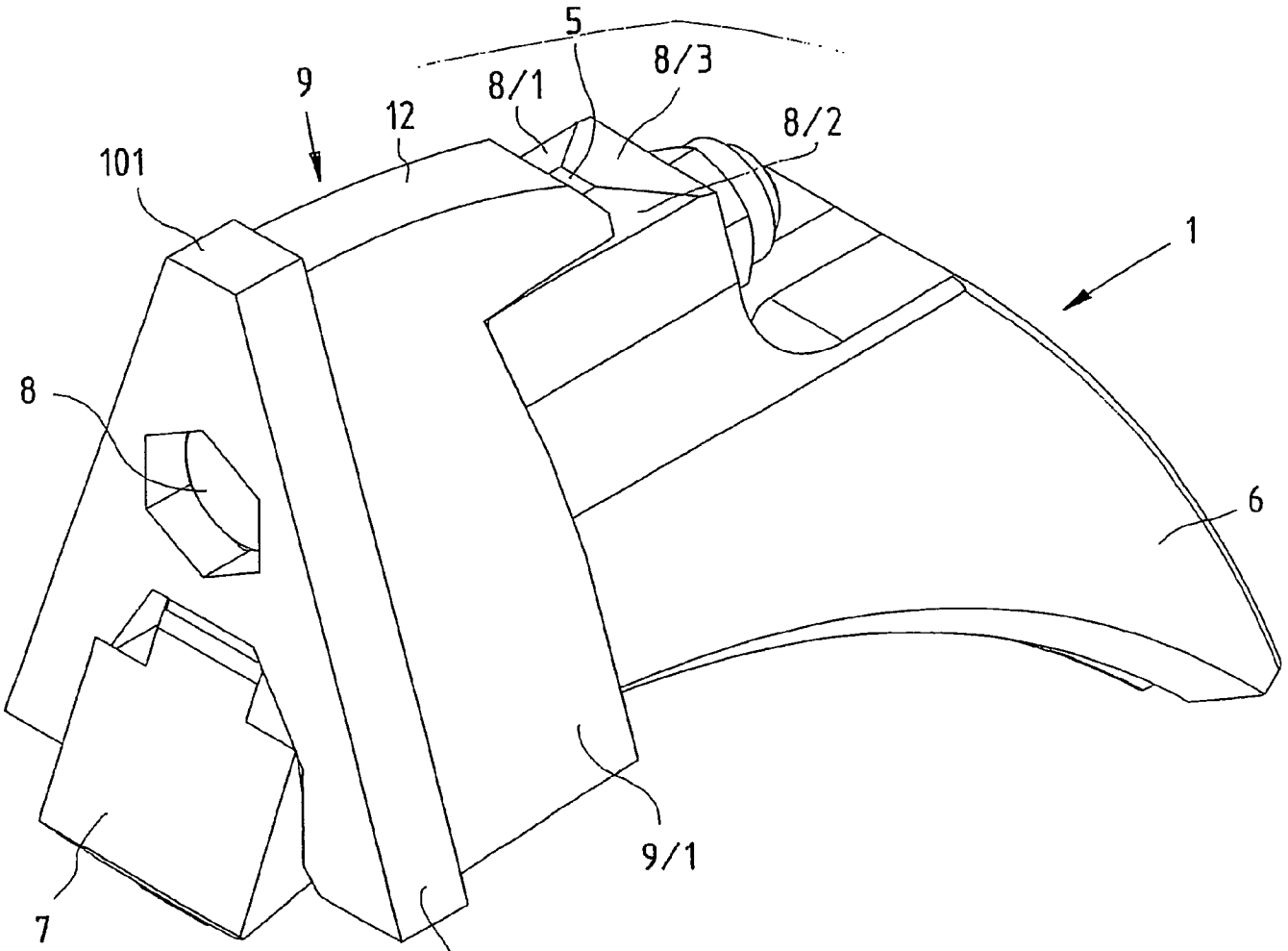
Figure 8C:
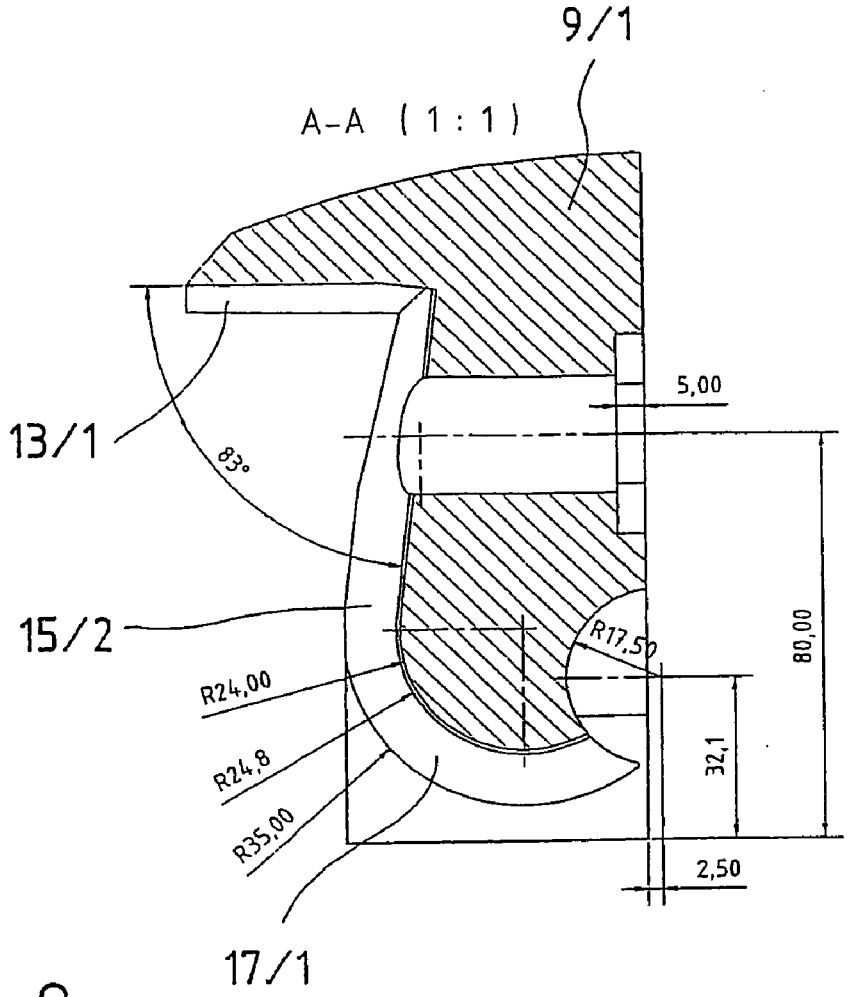
Figure 8B:
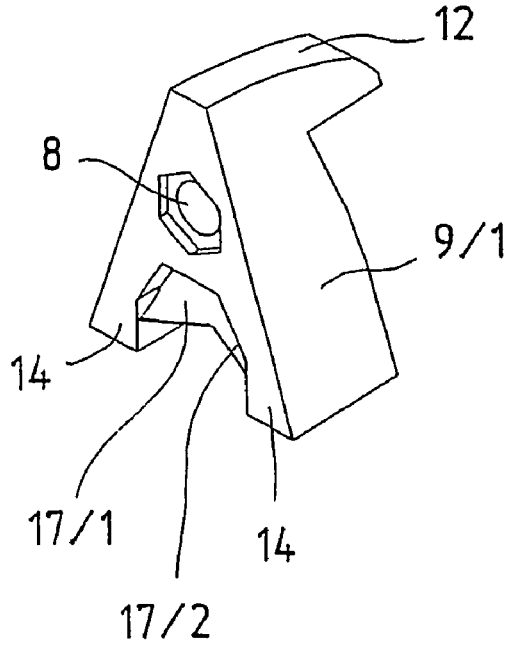
Figure 8D:
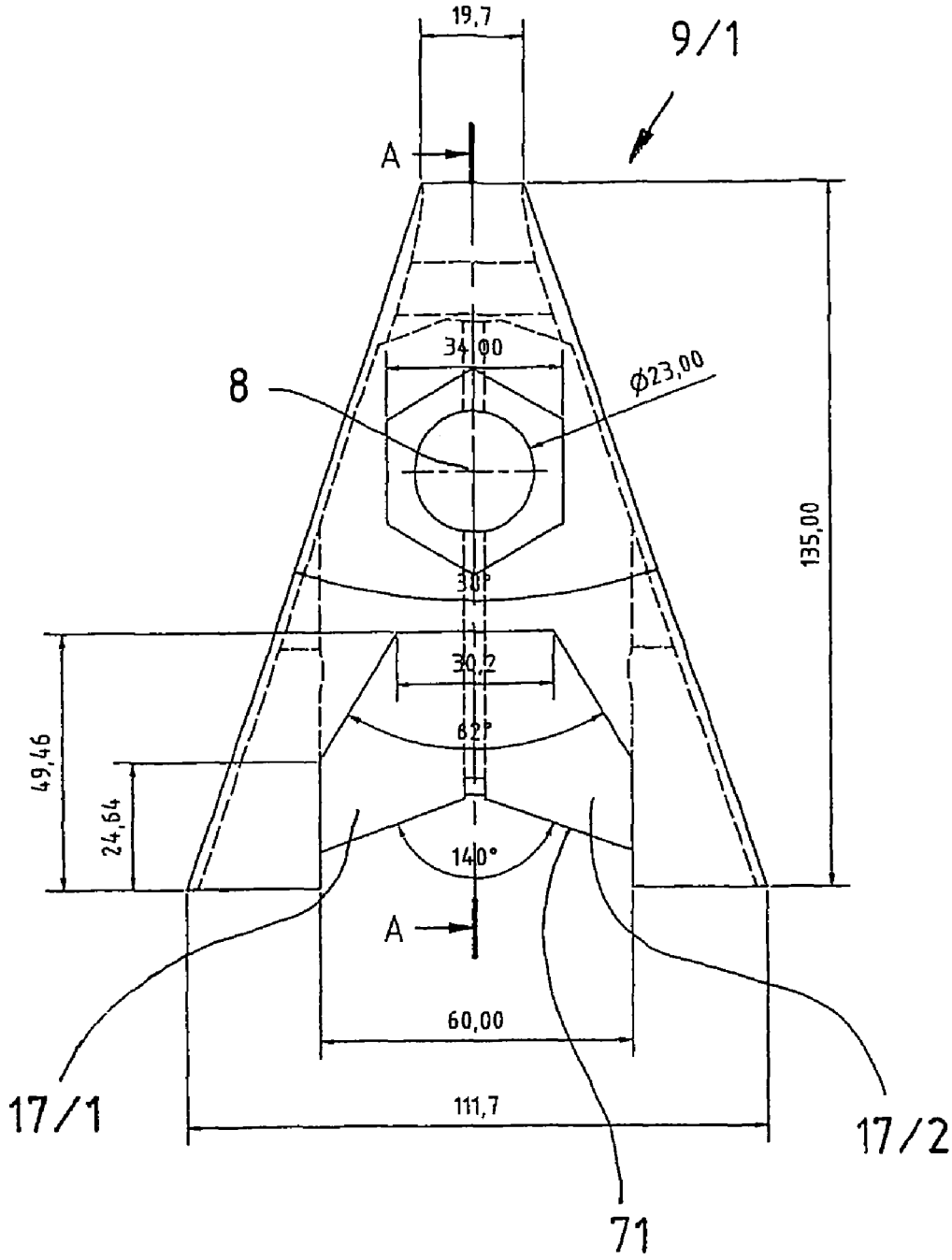
Figure 8E:
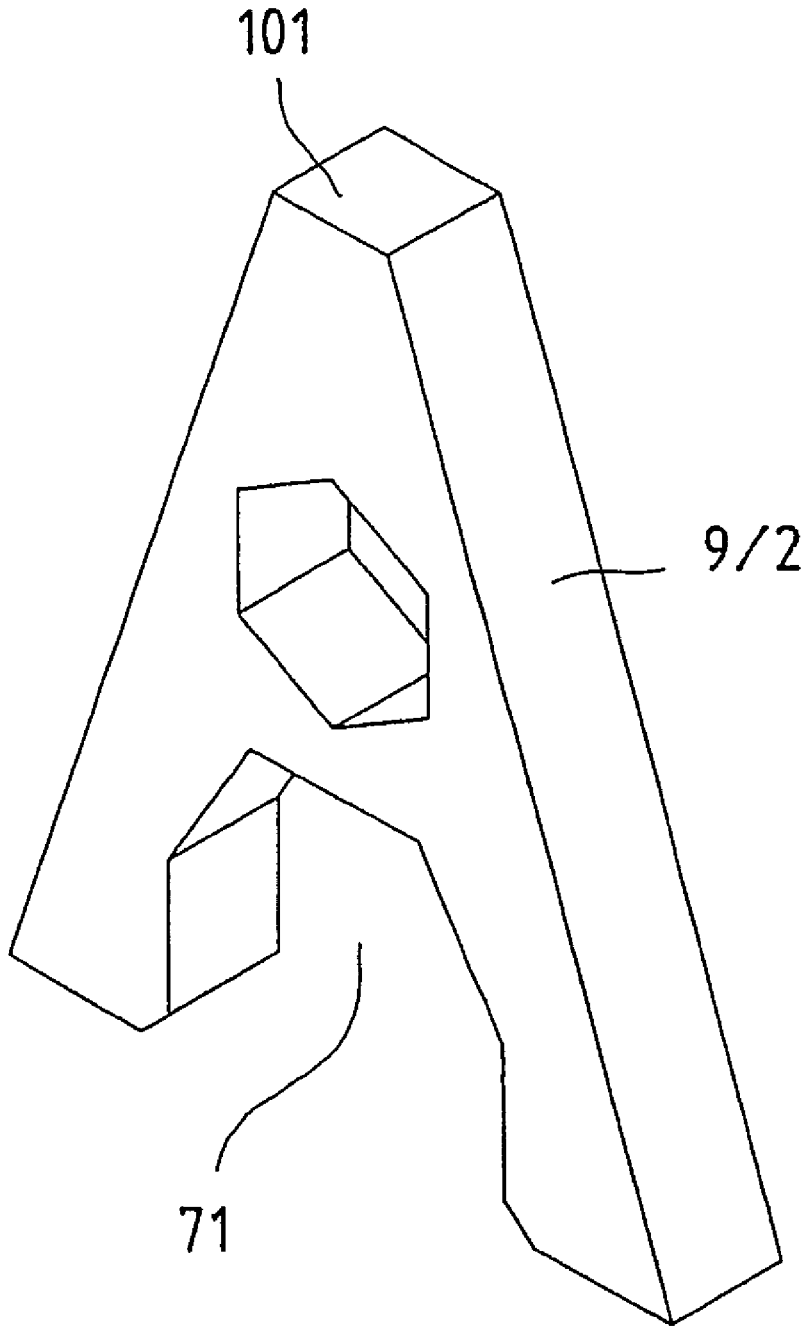
Figure 9:
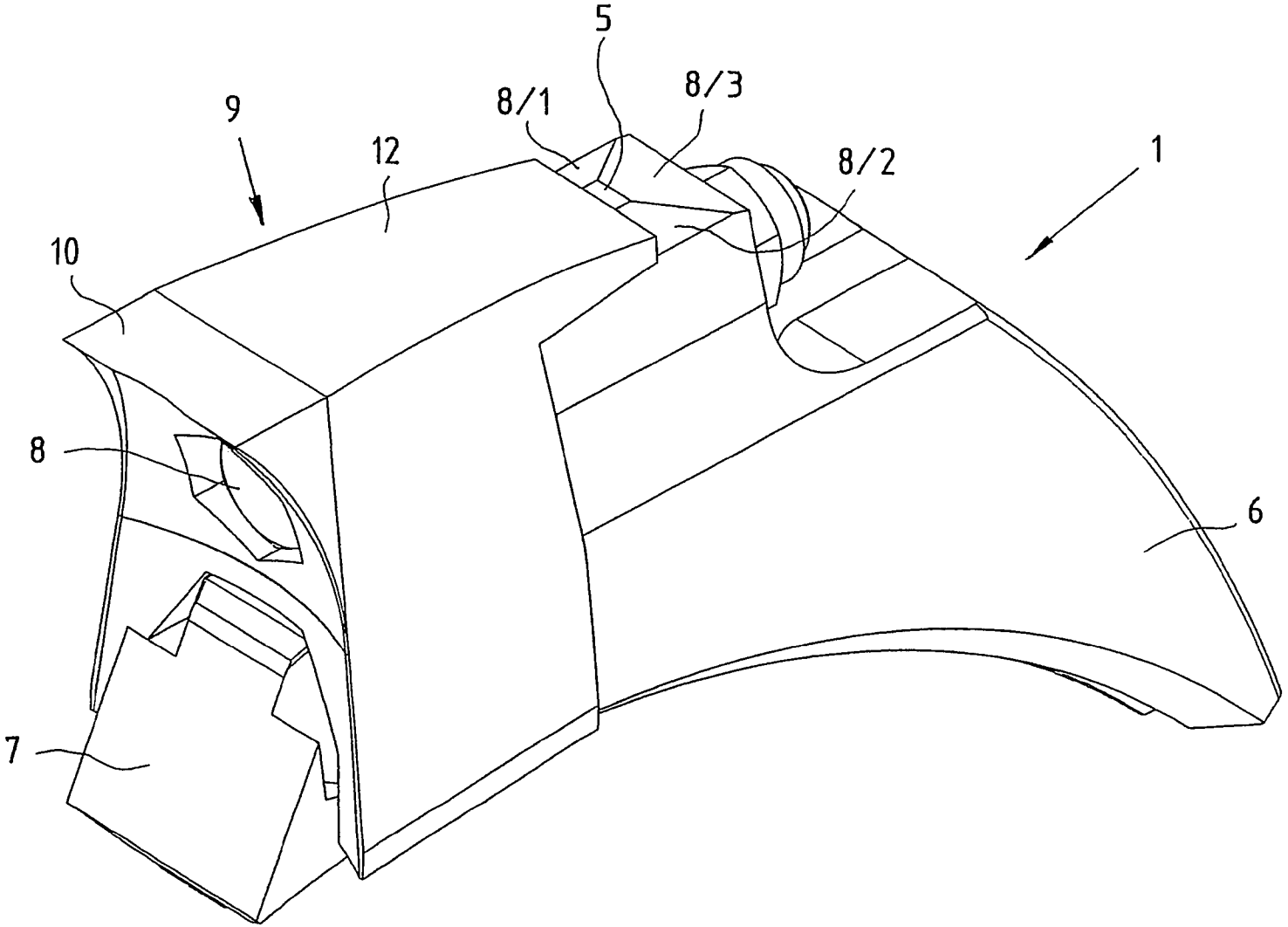
Figure 10:
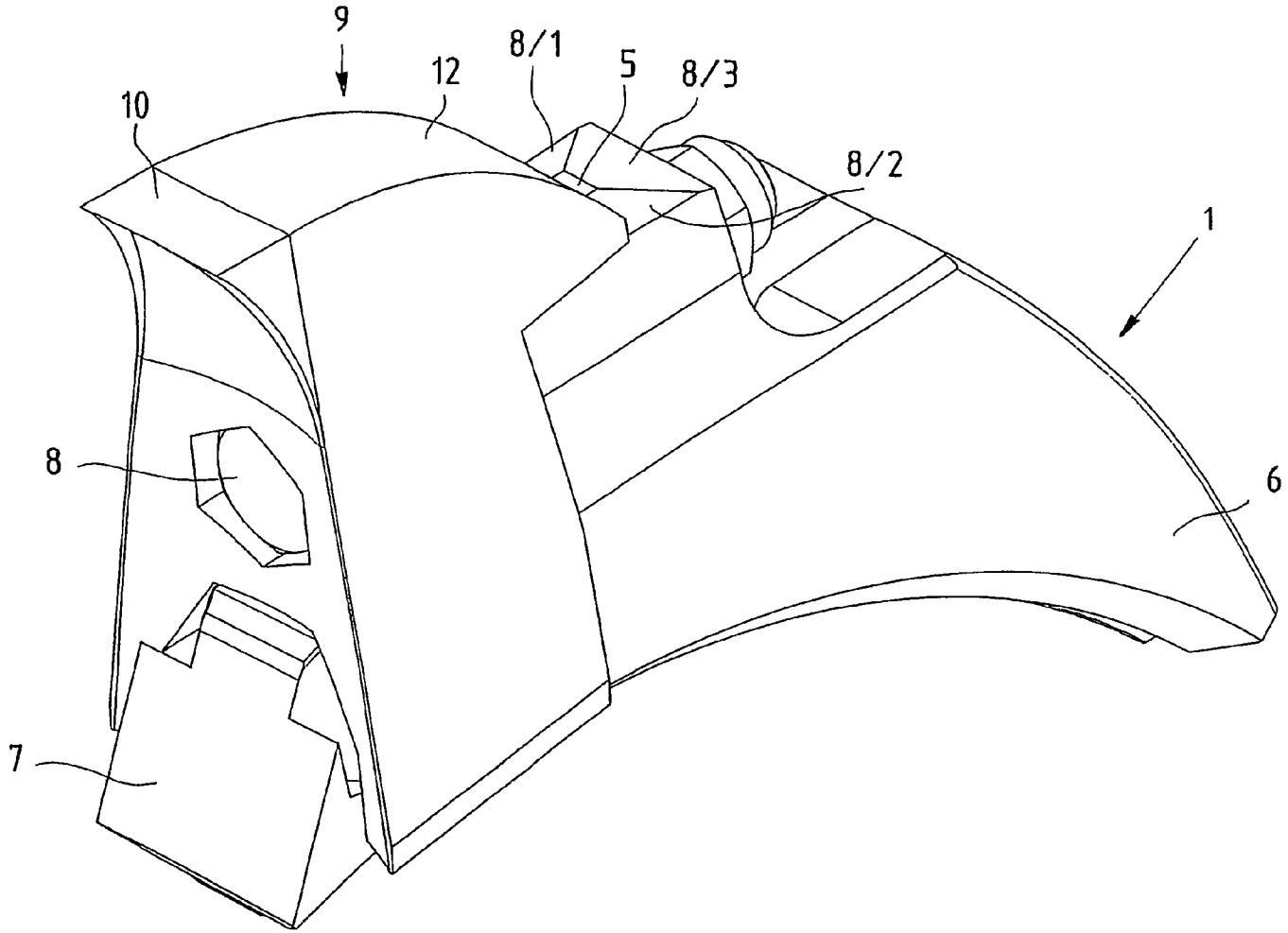

In the figures:

FIG. 1 A three dimensional view of an embodiment of a tooth body according to the invention, FIG. 2 a side view of the tooth body according to FIG. 1, FIG. 3 a three-dimensional view of a modification of a knife designed as tooth, FIG. 4 a side view of FIG. 3 in section, FIG. 5 a view from the bottom of FIG. 3, FIG. 6 another view of a tooth according to FIG. 3, FIGS. 7*a* & *b* several views of an embodiment for a tooth according to the invention, FIGS. 8*a-e* several views of a modification of an embodiment with a two-piece tooth, FIGS. 9 & 10 modifications of tooth bodies with differently designed teeth.

FIG. 1 shows a three dimensional view of an embodiment of a tooth body 1 according to the invention. This is designed in such a way that it can be placed upon a not shown comminution cylinder of a comminution device. On its side orientated in the direction of cutting there is a knife receiving device 3. The knife receiving device 3 is here designed as recess 4 and has the shape of a J. In this way in a very simple embodiment according to the invention already a positive-locking connection between the knife receiving device 3 and a knife 2 which can be put in, but is not shown here, can be obtained. The knife receiving device 3 has on its faces facing outward recess surfaces 4/1, 4/2 which are designed wedge-like tapering-off to the outside. The invention, however, can also be realized, according to a modification not shown, with recess surfaces tapering-off to the inside. At the tapering-off front end of the recess a nose 7 is provided which effects another optimizing of the positive-locking connection, but also a distribution of the stress which has to be applied. At the back top part of the recess 4 the supporting surfaces 5/1, 5/2 join which achieve the support of the knife 2 during cutting on the supporting body 5 as part of the tooth body 1. These supporting surfaces 5/1, 5/2 are also designed wedge-like, respectively conically tapering-off to the outside. The supporting body 5 has on its top surface supporting surfaces 8/1, 8/2, 8/3 on which the tooth is supported when put in. All surfaces are designed wedge-like, respectively conically tapering-off to the outside. The fastening of the knife 2, additionally provided to the positive-locking connection, in, respectively at, the tooth body 1 can be done by means of fastening means not shown, for example a screw. This is then guided through the boring 8. The part of the tooth body 1 opposite the direction of cutting has reference number 6.

There a centering device in the shape of a groove can be seen. This serves for centering and/or fixing the tooth body 1 on the comminution cylinder which then has corresponding means, for example a tongue, upon which the tooth body 1 is placed.

FIG. 2 shows a side view of the tooth body 1 according to FIG. 1. This serves for a better understanding. All features and reference numbers are used in the same way as described in FIG. 1 so that no new presentation is necessary.

FIG. 3 shows a three-dimensional view of a modification of a knife 2 designed a s tooth 9. Tooth 9 has a knife-edge 10 in the direction of cutting which is placed upon in the variant shown. This presents the possibility to place there, for example, harder and more enduring material like, for example, hard metal. Of course, tooth 9 may also be obtained from a complete body of one material, and the knife-edge or other parts of the tooth 9 are hardened. The material placed-upon can, for example according to a development of the invention, also be provided there by arming or welding-on. On the face 11 facing in the direction of cutting the tooth 9 is designed concave. At the edges, respectively sides, there are hardened regions 14. These regions also can be manufactured by arming, respectively welding-on. The boring 8 serves for receiving the fastening means not shown. On the side 12 opposite the knife-edge 10 the radius is selected in such a way that it cuts the radius of the cylinder body of the comminution cylinder not shown. At the end of the radius there is the supporting region 13 which interacts, when set in, with the supporting body 5 of the tooth body 1. The tooth 9 tapers off slightly wedge-like upwards, however, it is altogether designed slightly wider than the tooth body so that free cutting occurs.

FIG. 4 is the side view of FIG. 3 in section. It serves for better understanding of the presented embodiment of the invention.

FIG. 5 is a bottom view of the tooth 9 according to FIG. 3. Here the surfaces 17/1, 17/2 of tooth 9 interacting with the recess surfaces 4/1, 4/2, the surfaces 15/1 and 15/2 interacting with the supporting surfaces 5/1, 5/2, as well as the surfaces 13/1 and 13/2 which can be placed upon the top surface supporting surfaces 8/1, 8/2 can be seen.

FIG. 6 is another view of the tooth 9 according to FIG. 3. The reference numbers are identical with the ones for the Figs. already described and indicate the same features.

Figure 7B:
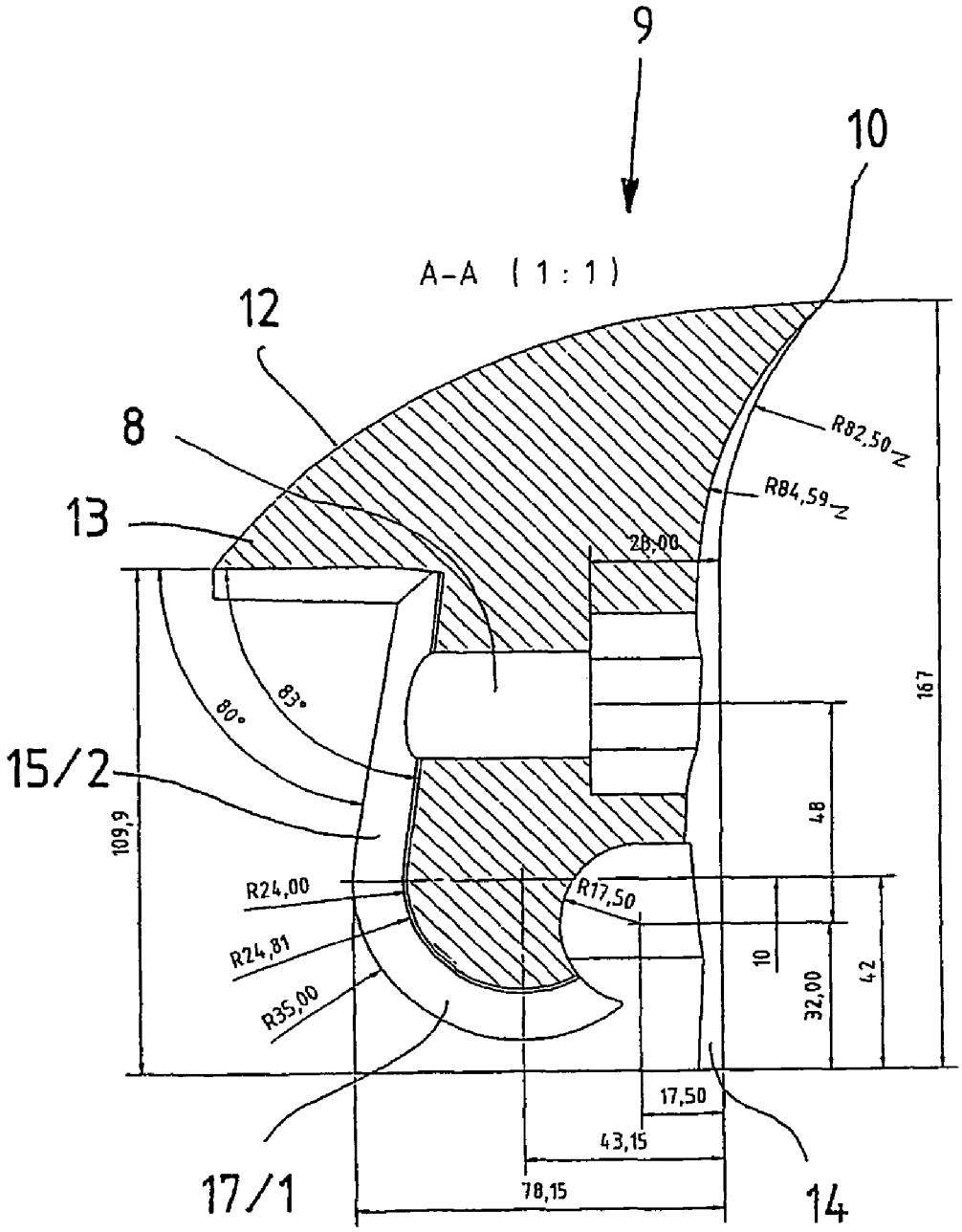

FIGS. 7*a* and 7*b* show different views of an embodiment for a tooth according to the invention. In the chosen example it is provided that the boring 8 has a diameter of 23 mm. The tooth, however, is only indicated schematically by reference number 9. It has on its top edge which is the knife-edge 10 for tooth 9, a width of 41.7 mm. The opening for the fastening screw, respectively for the hexagon provided for it, has a width of 34 mm. In the bottom region where the recess counter surfaces 17/1 and 17/2 are only indicated schematically, the interior side facing the recess 4 has a width of 30 mm. The two different angles for limiting the supporting surfaces have 62° and 140°, respectively. The height of the opening designed corresponding with nose 7 is 49.5 mm. The width of this opening is 60 mm, and the width of the tooth altogether is given with 86 mm. This embodiment is a preferred modification of the invention. However, the invention is not limited to this dimensions. Other modifications are rather possible. However, the modification presented here has proved very practically when the solution according to the invention has been tested.

FIG. 7*b* shows in a side view the section at the line A/A according to the view in FIG. 7*a*. The reference numbers used in this view have been used in the same way for features already presented. The angle information, respectively the radius dimensions of the individual surfaces of the tooth according to the invention, chosen for this preferred modification have not yet been presented. The radius at the knife-edge 10 of tooth 9 is in the top region and at the exterior edge 82.5 mm. The tooth is designed concavely so that the interior radius in this region is 84.59 mm. The radius correspondingly interacting with nose 7 is in the embodiment presented 17.5 mm, and the center point has here a distance of 32 mm to the bottom edge. The bottom surfaces of the tooth 9, which can be put in the recess 4, have a radius of 35 mm in the exterior region, and 24.8 mm in the interior region, and of 24 mm in the region orientated upwards of the bottom curvature. The angle between the supporting surface 13 and the back region of the tooth where the supporting counter surface 15/2 is located is 83° for the interior region, and 80° for the exterior region.

FIGS. 8*a* to 8*e* show different views of another very advantageous modification for an embodiment of the invention with a two-piece tooth 9. FIG. 8*a* here shows a three-dimensional view of a tooth 9 attached to a tooth body 1 by means of a fastening screw not indicated. Tooth 9 is formed in the shown example by a first cutting body 9/1 and a second cutting body 9/2. The cutting body 9/2 is designed here disc-like as interchangeable disc 101. The side of the first cutting body facing the second cutting body is designed flatly. The second cutting body 9/2 is designed as disc, respectively as plate, and has triangle-shape with a flattening on top. Thus the second cutting body 9/2 has the shape of a trapezoid. For passing through of the nose 7 the second cutting body 9/2 has a recess, so that it embraces the nose 7 when built in. The supporting surfaces 8/1, 812, 8/3 on which the first cutting body 9/1 is supported can also be seen very clearly in the drawing according to FIG. 8*a*.

FIGS. 8*b* and 8*c* show, on the one hand, in a three-dimensional view and, on the other hand, in a section the embodiment described before. Here, however, only the first cutting body 9/1 is shown. The dimensions of the angles and radii chosen in the view of FIG. 8*c* here correspond with another advantageous modification for the described embodiment of a two-piece tooth 9.

FIG. 8*d* shows another view where other dimensions of the embodiment can be discerned. Here in particular the bottom width of 117.7 mm, the width of the bottom opening 71 as well as the indicated angles are important for the chosen embodiment. It is, of course, an advantage that these angle dimensions always have the same size in particular in the interior in order to guarantee that the different teeth can be put on the tooth body 1 designed always identically of the knife holder according to the invention. All other dimensions and angles can be chosen variably according to the invention.

FIG. 8*e* shows the second cutting body 9/2, respectively this cutting body in an embodiment as interchangeable disc 101.

FIGS. 9 and 10 refer to other examples of embodiments of the invention. All reference numbers presented so far are used in the same way again. The difference between this two embodiments is that teeth 9 with different heights and thus different radii 12 are placed upon the tooth body 1.

The invention has been described before by means of examples. The claims filed with the application now and to be filed later on are attempted formulations without prejudice for obtaining a broader protection.

The references in the sub-claims relate to the further design of the matter in the main claim through the characteristics of the respective sub-claim. However, these are not to be understood as a waiver for independent protection of the matter for the characteristics of the referred sub-claims.

Characteristics only disclosed in the description so far, may now, in the course of proceedings, be claimed as being of inventive relevance, for example to distinguish from the state of the art.

The invention claimed is:

1. Knife holder for comminution devices, comprising a tooth body which can be fastened on a comminution cylinder, and a knife receiving device being provided in the tooth body for receiving at least one knife, wherein the at least one knife being able to be attached through positive-locking to the tooth body, characterised in that the knife receiving device is a recess, and, seen from the side, is in a J-shape, and the recess is in a wedge or conical shape.

2. The knife holder according to claim 1, characterised in that the tooth body is adapted to allow the knife to be attached to the tooth body in a fixed, releasable way and/or the knife holder is adapted to allow at least a part of the knife to be put in the knife holder.

3. The knife holder according to claim 1, characterised in that the knife holder is arranged at the front end of the tooth body seen in the direction of cutting and/or the recess has at its front end, seen in the direction of cutting, a nose, and/or the recess has at its front end, seen in the direction of cutting, a nose and the nose of the recess is in a cylinder shape.

4. The knife holder according to claim 1, characterised in that a part of the tooth body comprises a supporting body with supporting surfaces which are in a wedge or conical shape and the supporting surfaces are provided on a side of the supporting body facing the knife.

5. The knife holder according to claim 1, characterised in that the tooth body has shapes which correspond with the knife and the tooth body is fastened on, the comminution cylinder of the comminution device by welding or the tooth body is arranged on the comminution cylinder.

6. The knife holder according to claim 1, characterised in that the tooth body has on its bottom surface, respectively on the surface facing the comminution cylinder, a centering device for centering the cylinder or a centering device is provided and the centering device of the tooth body is designed as groove or tongue, which interacts with a tongue or groove provided on the comminution cylinder in

7. The knife holder according to claim 1, characterised in that tooth body has fastening means by means of which it can be fastened to the knife in a fixed, releasable way, and/that the fastening metals is presented by at least one screw connection which is guided by a boring in the tooth body and in the knife, whereas the boring has a diameter of 23 ram.

8. The knife holder according to claim 1, characterized in that the tooth body is made of metal as castings and/or the tooth body has side surfaces and the side surfaces of the tooth body taper off diagonally upward, taper or taper off to the outside radius, respectively, and/or the tooth body is designed narrower opposite the cutting direction than at the cutting edge.

9. The knife holder according to claim 1, characterized in that the outside radius of the tooth body cuts on the outside radius of the comminution cylinder on its side opposite to the knife receiving device and/or the knife receiving device is designed in such a way that knives of differing shapes, including triangle, rectangular or polygon knives, can be put in, respectively attached.

10. A comminution device with at least one knife holder according to claim 1.

11. A comminution device with at least one knife holder according to claim 1, characterised by a number of knife holders which are arranged on the comminution cylinder staggered to each other.

12. The knife holder according to claim 5, wherein the tooth body is arranged on the comminution cylinder angularly staggered to another tooth body on the comminution cylinder.

13. An assembly of a knife and a knife holder for comminution devices, comprising:

the knife being designed as a tooth; and the knife holder comprising a tooth body which can be fastened on a comminution cylinder, and a knife receiving device being provided in the tooth body for receiving the knife, wherein the knife is able to be attached through positive-locking to the tooth body, and wherein the knife receiving device is a recess, and seen from the side is in a J-shape, and the recess is in a wedge or conical shape.

14. The assembly according to claim 13, characterized in that the knife is attached to the tooth body in a fixed, releasable way.

15. The assembly according to claim 13, characterized in that the knife is made of metal as casting.

16. The assembly according to claim 13, characterized in that the tooth has a knife-edge and is designed concave on the side oriented in a direction of cutting.

17. The assembly according to claim 13, characterized in that the tooth has a radius on its side opposite to the tooth body which cuts the radius of the comminution cylinder, respectively of the cylinder body, and wherein the radius of the tooth on the side opposite to the tooth body can be adapted to differing heights of teeth.

18. The assembly according to claim 13, characterized in that the tooth body has a supporting body and at the tooth a supporting region is provided which is supported by the supporting body, and wherein at the supporting region supporting surfaces in a conical or wedge shape are provided in which the tooth is designed wider than the tooth body, in such a way that the result is free cutting.

19. The assembly according to claim 13, characterized in that the tooth is in conical or wedge shape, on the sides facing the tooth body corresponding with the recess surfaces and the supporting surfaces, in such a way that auto-centering is the result of the positive-locking connection during fastening the tooth.

20. The assembly according to claim 13, characterized in that the tooth has a placed- upon knife-edge which is made from hard metal, and/or wherein the size of the tooth can be adapted because of differing comminution problems, and the height, measured between the tip of the knife-edge and the out side radius of the communition cylinder, has between 100 mm and 200 mm.

21. The assembly according to claim 13, characterized in that the tooth has at least one hardened region on its edges orientated in the direction of cutting, and/or the at least one hardened region has been obtained by arming or welding-on, and/or the tooth is designed in two pieces from a first cutting body and a second cutting body.

22. The assembly according to claim 13, characterized in that the tooth is designed in two pieces from a first cutting body and a second cutting body, wherein the first cutting body is flat, respectively plane.

23. The assembly according to claim 13, characterized in that the tooth is designed in two pieces from a first cutting body and a second cutting body, wherein each of the first cutting body and the second cutting body is in a disc shape and/or provided with an opening, which embraces in built-in condition a nose, in which the second cutting body is designed as interchangeable disc, and/or wherein the second cutting body is designed as interchangeable disc and wherein the interchangeable disc has a thickness of 20 mm, and/or wherein the second cutting body is designed as an interchangeable disc and the interchangeable disc has the shape of a triangle which is flattened on the side on top in built-in condition in such a way that the interchangeable disc has the shape of a trapezoid.

24. The assembly according to claim 13, characterized in that two recess counter surfaces on the tooth face the tooth body and are orientated downward to the recess, and the inclination of these two recess counter surfaces corresponds with that of a first part of the recess; and two supporting counter surfaces on the tooth face the tooth body and are orientated horizontally, and the inclination of these two supporting counter surfaces corresponds with that of a second part of the recess.

* * * * *